US007226641B2

(12) United States Patent
Vega et al.

(10) Patent No.: US 7,226,641 B2
(45) Date of Patent: Jun. 5, 2007

(54) THERMAL PROCESS FOR WHEELS

(75) Inventors: Luis Fanor Vega, Cheswick, PA (US); Thomas Levendusky, Greensburg, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 11/343,089

(22) Filed: Jan. 30, 2006

(65) Prior Publication Data

US 2006/0172069 A1 Aug. 3, 2006

Related U.S. Application Data

(60) Provisional application No. 60/647,835, filed on Jan. 28, 2005.

(51) Int. Cl.

| | |
|---|---|
| ***B05D 7/14*** | (2006.01) |
| ***B05D 7/16*** | (2006.01) |
| ***B05D 1/02*** | (2006.01) |
| ***B05D 1/26*** | (2006.01) |
| ***B05D 1/28*** | (2006.01) |
| ***B05D 1/36*** | (2006.01) |
| ***B05D 1/40*** | (2006.01) |
| ***B05D 3/02*** | (2006.01) |
| ***B05D 3/06*** | (2006.01) |

(52) U.S. Cl. ..... 427/388.1; 427/258; 427/421.1; 427/427.4; 427/427.5; 427/427.6; 427/299; 427/327

(58) Field of Classification Search ..... 427/100, 427/180, 189, 195, 202, 203, 258, 261, 287, 427/307, 314, 318, 372.2, 375, 384, 385.5, 427/388.1; 148/240, 243
See application file for complete search history.

(56) References Cited

U.S. PATENT DOCUMENTS

2004/0011434 A1* 1/2004 Sakai ..... 148/415

FOREIGN PATENT DOCUMENTS

| | | |
|---|---|---|
| JP | 2000-247101 | 9/2000 |
| JP | 2001-104871 | 4/2001 |
| JP | 2001-104871 A * | 4/2001 |

* cited by examiner

*Primary Examiner*—William Phillip Fletcher, III
(74) *Attorney, Agent, or Firm*—Greenberg Traurig LLP; Harry A. Hild

(57) ABSTRACT

This invention discloses a method of coating an object while increasing the temper of an object to peak strength. The method of increasing the temper of the object to peak strength includes providing an object having a substantially homogeneous solution of a precipitate hardening composition; and applying an image atop at least a portion of the object, wherein temperature and time of applying the image provide peak strength in the object. The image may be applied to the object surface by dye sublimation. The object may be a vehicle wheel formed of aluminum.

20 Claims, 3 Drawing Sheets

CLEAR COAT

| Temperature C | Age Time min. | Bar Number | Yield Ksi | Tensile Ksi | Elongation % |
|---|---|---|---|---|---|
| 170 | 131 | 1D | 37.2 | 41.7 | 19.3 |
| | | 2D | 36.9 | 41.8 | 19.3 |
| | | 3D | 33.9 | 39.9 | 22.7 |
| | | 4D | 34.7 | 41.1 | 18.7 |
| | | 5D | 33.3 | 42.2 | 21.3 |
| average | | | **35.2** | **41.3** | **20.3** |

IMAGE

| Temperature C | Age Time min. | Bar Number | Yield Ksi | Tensile Ksi | Elongation % |
|---|---|---|---|---|---|
| 173 | 106 | 1C | 39.0 | 43.3 | 5.0 |
| | | 2C | 39.3 | 45.9 | 12.0 |
| | | 3C | 34.7 | 42.4 | 11.0 |
| | | 4C | 38.1 | 45.8 | 16.0 |
| | | 5C | 34.8 | 44.8 | 18.0 |
| average | | | **37.2** | **44.4** | **12.4** |

PRIMER COAT

| Temperature C | Age Time min. | Bar Number | Yield Ksi | Tensile Ksi | Elongation % |
|---|---|---|---|---|---|
| 190.5-200 | 81 | 1B | 39.3 | 46.3 | 21.0 |
| | | 2B | 34.4 | 41.0 | 18.0 |
| | | 3B | 29.1 | 39.6 | 26.0 |
| | | 4B | 32.1 | 40.2 | 23.0 |
| | | 5B | 31.2 | 40.7 | 23.0 |
| average | | | **33.2** | **41.6** | **22.2** |

BASE COAT

| Temperature C | Age Time min. | Bar Number | Yield Ksi | Tensile Ksi | Elongation % |
|---|---|---|---|---|---|
| 181-185 | 26 | 1A | 24.1 | 40.5 | 25.0 |
| | | 2A | 23.2 | 39.2 | 23.0 |
| | | 3A | 23.7 | 39.5 | 21.0 |
| | | 4A | 22.6 | 39.9 | 25.0 |
| | | 5A | 23.1 | 39.6 | 25.0 |
| average | | | **23.3** | **39.7** | **23.8** |

FIGURE 3

THERMAL PROCESS FOR WHEELS

CROSS REFERENCE TO RELATED APPLICATION

The present invention claims the benefit of U.S. provisional patent application 60/647,835, filed Jan. 28, 2005, the whole contents and disclosure of which is incorporated by reference as is fully set forth herein.

FIELD OF THE INVENTION

This invention relates generally to vehicle wheel manufacturing. Specifically, this invention relates to a method of increasing the temper of a vehicle wheel to peak strength during a coating process.

BACKGROUND OF THE INVENTION

The demand for aluminum wheels increases each year as automotive manufacturers move away from wheels that are fabricated from steel. The reason for the automotive industry's shift from steel wheels to aluminum wheels is driven by a variety of factors. For example, aluminum wheels are lighter than their steel counterparts and therefore contribute to the overall weight savings of an automotive vehicle. The decrease in overall weight increases the fuel economy and improves the performance and handling of the automotive vehicle. Additionally, many consumers feel that aluminum wheels offer superior aesthetic qualities over their steel counterparts.

The aesthetic characteristics of aluminum wheels are improved by surface treatment processes to the metal, such as fine machining and/or polishing or buffing. Once the metal is imparted with the desired finish and luster, it is then preserved by application of an protective coating. Technologies typically utilized for this protection consist of clear lacquers either in liquid or powder form followed by a thermal curing step in order to achieve full polymerization. In some instances, intermediate color coats are applied so that to further enhance the styling of the finished product.

In other instances, aluminum wheels are coated or decorated with an image or pattern to enhance the wheel's aesthetic qualities. The techniques used to coat or decorate the vehicle wheel are well known in the art. For instance, dye sublimation, ink jet printing, screen printing, pad printing, or specialized liquid/powder spraying may all be used to coat the vehicle wheel with the desired image. Typically, the metal substrate of a vehicle wheel is at peak strength (i.e. T6 temper) prior to being coated with the desired image. In order to reach peak strength, the vehicle wheel is usually subjected to a number of annealing steps after initial fabrication, such as solution heat treatment and aging. In combination with surface protection and decoration processes, these steps require time and power which ultimately leads to increased production and consumer costs. Therefore, there exists a need for a method to reduce the total number of annealing steps needed to fabricate a coated/decorated vehicle wheel having a T6 temper.

SUMMARY OF THE INVENTION

The present invention provides a method of increasing the temper of an object to peak strength during the process of applying a decorative image to the objects' surface. Broadly, the method includes:

providing an object having a substantially homogeneous solution of a precipitate hardening composition; and applying an image atop at least a portion of said object, wherein temperature and time of at least said applying of said image provide peak strength in said object.

Applying the image to the wheel may further include applying and curing a primer coat to the objects' surface and then applying the image to the primer coat at a temperature to ensure adhesion of the image to the primer coat. The method may further include the application of a base coat prior to primer application. A clear coat may also be formed atop the image. When present, the curing time and temperature of the base coat and clear coat is selected to work in conjunction with the primer and image application processing steps to increase the mechanical properties of the object to peak strength.

The object may be fabricated from an aluminum alloy. More specifically, the object disclosed in this invention is an aluminum vehicle wheel fabricated from Aluminum Association's A356, 6061 or 5454 aluminum alloy.

The base coat may be a liquid or a powder acrylic that may be cured at a temperature ranging from about 150° C. to about 205° C. (300° F. to 400° F.) at a time interval ranging from about 20 minutes to about 75 minutes.

The powder coating primer may include polyester and is applied over the base coat at a thickness ranging from about 50 microns to about 100 microns and may be cured at a temperature from about 150° C. to about 205° C. (400° F.) for a time interval ranging from about 20 minutes to about 45 minutes.

The clear coating may include polyester, which may be cured at a temperature ranging from about 150° C. to about 205° C. for a time interval ranging from about 20 minutes to about 40 minutes.

The image can be applied onto the object using technologies including, but not limited to: dye sublimation, ink jet printing, screen printing, pad printing, specialized liquid/powder spraying, or similar printing processes.

In another aspect of the invention, a method is provided for heat treating an automotive wheel to peak strength during the application of an image from an air-permeable ink support material. Broadly, the method includes:

providing a vehicle wheel having a substantially homogeneous solution of a precipitate hardening composition;

applying an adhesion layer to said wheel;

contacting the adhesion layer with an ink support material having an image disposed thereon; and applying a vacuum to the wheel and ink support material at a temperature to transfer the image from the ink support material onto the adhesion layer, wherein temperature and time for applying one of at least said adhesion layer and said image provides peak strength in said vehicle wheel.

BRIEF DESCRIPTION OF THE DRAWINGS

FIG. 3 depicts a Table illustrating the strength characteristics of a vehicle wheel that was coated in accordance with the present invention.

DETAILED DESCRIPTION OF PREFERRED EMBODIMENT

The accompanying figures and the description that follow set forth this invention in its preferred embodiment. However, it is contemplated that persons generally familiar with coated aluminum parts will be able to apply the novel characteristics of the structures and methods illustrated and described herein in other contexts by modification of certain details. Accordingly, the figures and description are not to be taken as restrictive on the scope of this invention, but are to be understood as broad and general teachings. When referring to any numerical range of values, such ranges are understood to include each and every number and/or fraction between the stated range minimum and maximum.

Figure 1:
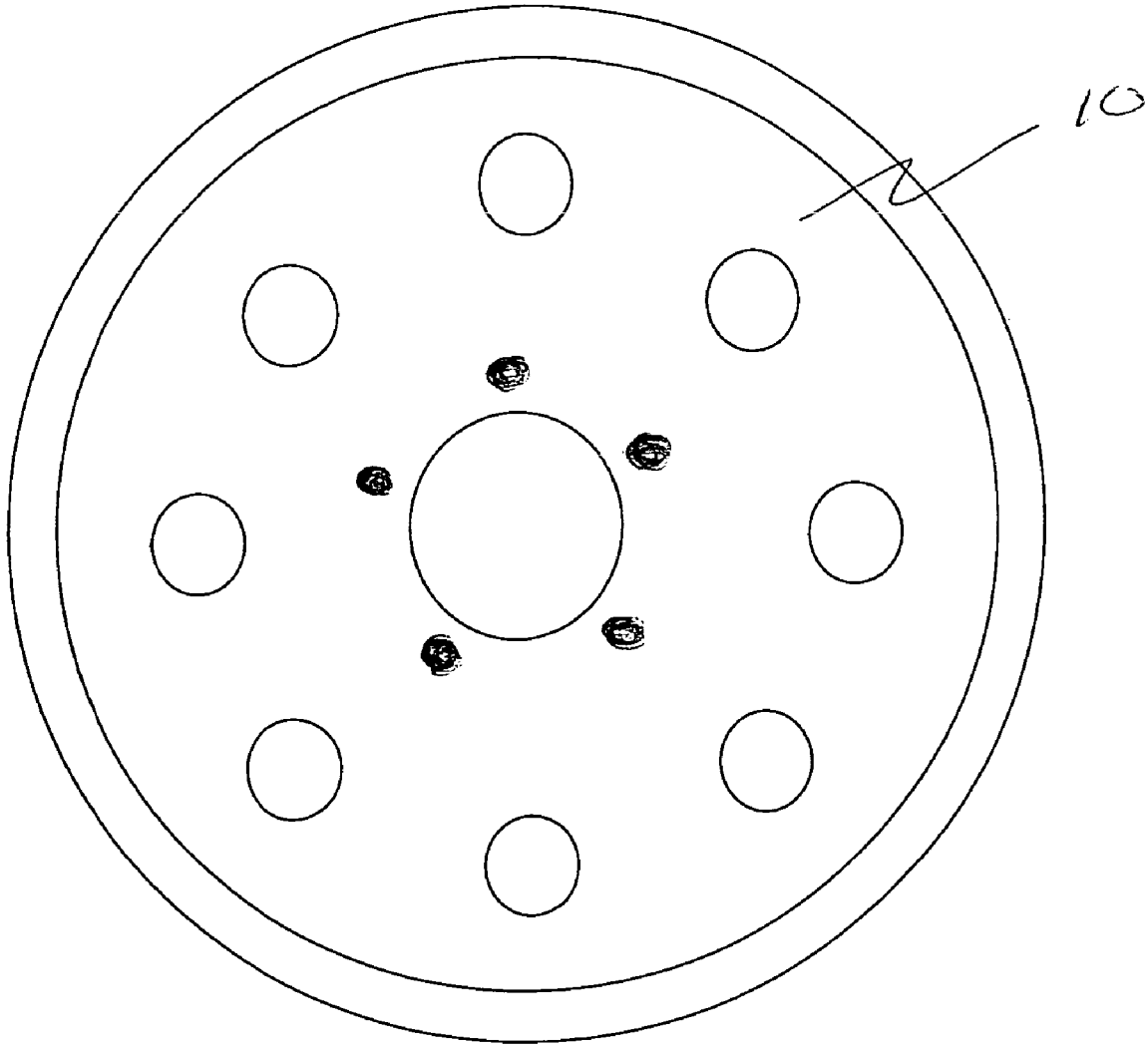
FIG. 1 (prospective view) depicts a wheel that has been coated and heat treated in accordance with the present invention.

This invention discloses a method for applying a coating to a metal object, preferably being a vehicle wheel 10, as depicted in FIG. 1, which provides a heat treatment to increase the vehicle wheels' mechanical properties to peak strength. The term "peak strength" denotes the maximum tensile strength or yield strength that may be achieved for a given precipitate hardening composition, such as, but not limited to, AlMgSi alloy systems. Although, the following disclosure refers to vehicle wheels, the present invention is equally applicable to any metal object that may be coated and heat treated to peak strength.

Specifically, the method of the present invention increases the vehicle wheel's mechanical properties by utilizing the heating steps of the coating process to artificially age the vehicle wheel to it's peak strength (i.e. T6 temper). Although, it is preferred that the heat treatment includes process steps that correspond to separate coating compositions of the coating process, it is noted that any number of steps may be utilized, so long as the wheel is not overaged when peak strength is required. The method is now described in greater detail.

Figure 2:
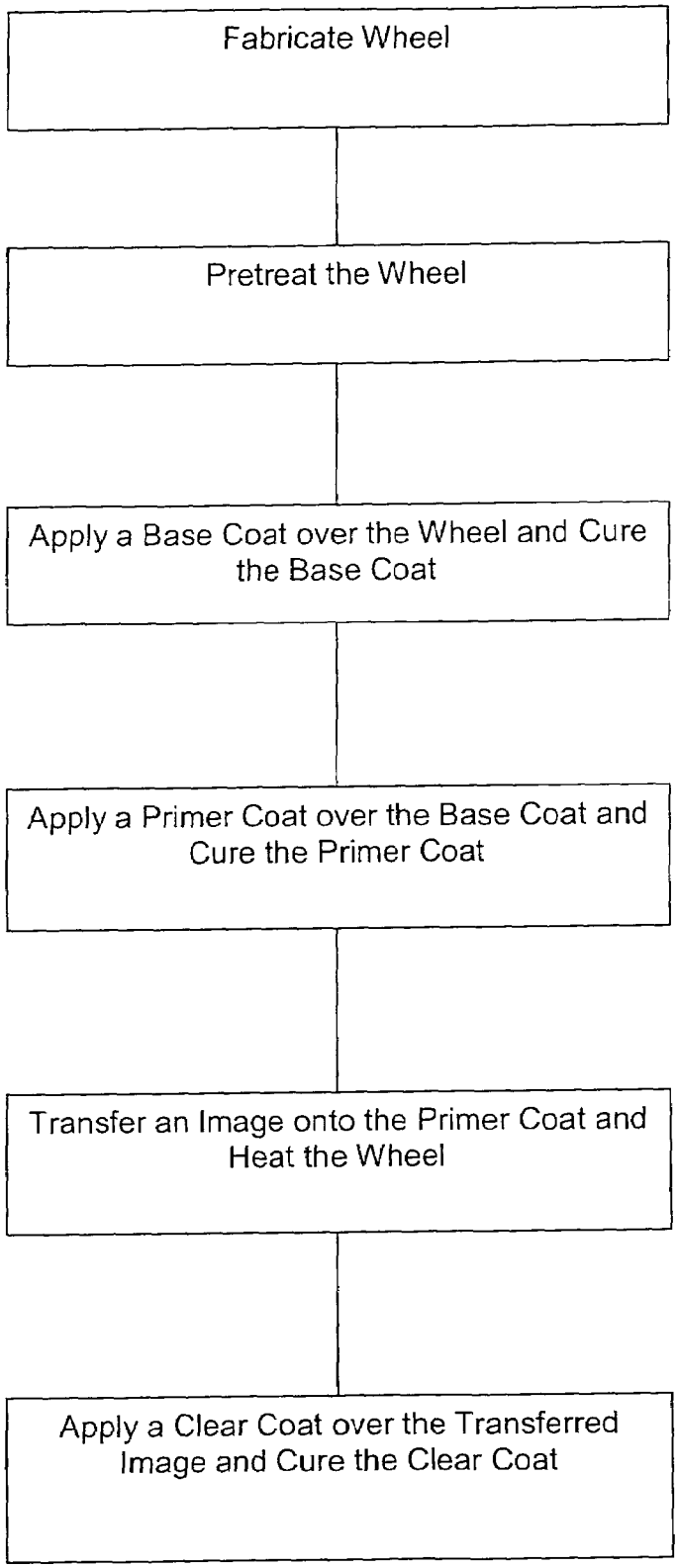
FIG. 2 is a Flow Diagram depicting one preferred embodiment of the method that is disclosed in this invention.

As can be understood from FIG. 2, a vehicle wheel is fabricated using a cast or forging process. The vehicle wheel may include any metal alloy composition that may be precipitated hardened. More specifically, the vehicle wheel may include an alloy composition whose strength characteristics may be enhanced by the formation of uniformly dispersed particles (precipitates) of a second phase within the original phase matrix, which are formed using heat treatments of the inventive method that correspond to the coating process. In one preferred embodiment, the precipitate hardening is provided by the formation of uniformly dispersed $Mg_2Si$ precipitates.

Preferably, the vehicle wheel comprises an aluminum alloy, such as Aluminum Association's 356, 6061 or 5454. In one example, the aluminum alloy is substantially composed of 6.5–7.5 wt. % Si, up to 0.6 wt. % Fe, up to 0.2 wt. % Cu, up to 0.35 wt. % Mn, 0.2–0.45 wt. % Mg, up to 0.35 wt % Zn, and up to 0.25 wt. % Ti. In another example, the aluminum alloy is substantially composed of up to 0.25 wt. % Si, up to 0.4 wt. % Fe, up to 0.1 wt. % Cu, 0.5–1.0 wt. % Mn, 2.4–3.0 wt. % Mg, 0.05–0.20 wt. % Cr, up to 0.25 wt % Zn, and up to 0.20 wt. % Ti. In another embodiment, the aluminum alloy is substantially composed of 0.4–0.8 wt. % Si, up to 0.7 wt. % Fe, 0.15–0.4 wt. % Cu, up to 0.15 wt. % Mn, 0.8–1.2 wt. % Mg, 0.05–0.20 wt. % Cr, up to 0.25 wt % Zn, and up to 0.15 wt. % Ti.

After the wheel is fabricated, it is typically machined and roll stamped into its final product form, polished, buffed, and then cleaned with water or an alkaline solution to remove debris. Following machining the wheel may be solution heat treated. In some alloys, to take full advantage of the precipitation hardening reaction, it is advantageous to first produce a solid homogeneous solution. In one embodiment, this may be achieved through solution heat treating, and its objective is to take into solid solution the maximum practical amounts of the soluble hardening elements in the alloy. The process typically consists of soaking the alloy at a temperature sufficiently high and for a time long enough time to provide dissolution of the soluble phases and achieve a nearly homogeneous solid solution. In one example, in AlMgSi alloys, the temperature range may be from 515° C. to 540° C. It is noted that the time of the solution heat treatment may be adjusted with respect to temperature to ensure that a homogeneous solid solution is provided. Following heat treatment the wheel is rapidly cooled, i.e. quenched, to ensure that the solid solution is maintained, preferably in a supersaturated state.

Prior to coating processes to the cleaned wheel, the wheel can be pretreated with cobalt-containing non-chromium treatments or with chromium chromate or zinc phosphate pretreatments thereby enhancing the coating (base coat's) ability to remain attached to the wheel. The objective of this pretreatment is to impart adhesion between the metal substrate and the first layer of the coating, without damaging the structural characteristics of the metal, such as fatigue and corrosion fatigue. As a result, other aluminum oxide modification treatments could also be utilized, such that the chemical composition and physical characteristics of the resulting surface is compatible with the properties of the polymer compound. Once the pre-treatment step is complete, the wheel is then washed and dried.

A clear liquid or powder base coat is then applied to the dried wheel using techniques that are well known in the art. For example, the base coat can be applied to the surface of the wheel using a spray, curtain, or dipping method. In one embodiment, the base coat may include an acrylic based powder coating. The base coat may serve as an adhesion layer for the subsequently formed primer coat. Table 1 discloses the oven temperature and oven cycle times that are used to cure the base coat onto the surface of the vehicle wheel.

TABLE 1

Oven Temperature and Oven Cycle Times for Curing the Base Coat

| Oven Temperature (° C.) | Oven Cycle Time (minutes) |
|---|---|
| 150–160 | 20–75 |
| 160–170 | 20–75 |
| 170–180 | 20–75 |
| 190–200 | 20–75 |
| 200–205 | 20–75 |

As can be seen in Table 1, after the application of the base coat the wheel is cured at a temperature ranging from about 150° C. to about 205° C. with an oven cycle time ranging from about 20 minutes to about 75 minutes. It is preferred, that the cycle time range from 20 minutes to 30 minutes. It is noted that the ranges disclosed in Table 1 include every number and/or fractional value within the disclosed ranges. For example, the oven cycle time can range from about 20 minutes to about 35 minutes, from about 35 minutes to about 50 minutes, from about 50 minutes to about 65 minutes, or from about 65 minutes to about 75 minutes. Curing the base coat may be one of the heating steps that increase the temper of the wheel to peak strength. Although, a base coat is preferred, the base coat may be omitted, so long as the primer powder coat adheres to the surface of the wheel. In one embodiment, a masking step is employed to apply the base coat to only a portion of the wheel, as opposed to the wheel's entire surface.

The wheel is then cleaned using a methyl ethyl ketone (MEK) solvent to remove debris from the wheel and a powder coating primer (see FIG. 2) is applied over the base coat using spraying techniques that are known to those skilled in the art. The powder coating primer may serve as an adhesion layer for the image and ensures that the subsequently formed image adheres to the base coat or the wheel. In one embodiment, the primer is a polyester powder. Typically, the primer is pigmented with a color ranging from white to tan to gray.

TABLE 2

Powder Coating Primer Thickness and Oven Temperature

| Powder Coating Thickness (microns) | Oven Temperature (° C.) |
|---|---|
| 50–55 | 205 |
| 55–60 | 205 |
| 60–65 | 205 |
| 65–70 | 205 |
| 70–75 | 205 |
| 75–80 | 205 |
| 80–85 | 205 |
| 85–90 | 205 |
| 90–95 | 205 |
| 95–100 | 205 |

Table 2 discloses the thickness of the powder coating primer that can be applied to the surface of the vehicle wheel and the oven temperature at which the coating is cured. As can be seen in Table 2, the thickness of the powder coating primer can range from about 50 to about 100 microns. Preferably, the thickness of the powder coating primer is about 75 microns. It is noted that the ranges disclosed in Table 2 include every number and/or fractional value within the disclosed ranges. Once the powder coating primer is applied to the vehicle wheel, the wheel is cured in an oven at a temperature of about 205° C. (400° F.) or less. The curing cycle time is disclosed in Table 3 below.

TABLE 3

Cycle Time and Temperature for Curing the Powder Coating Primer:

| Curing Cycle Time (minutes) | Oven Temperature (° C.) |
|---|---|
| 20–25 | 205 |
| 25–30 | 205 |
| 30–35 | 205 |
| 35–40 | 205 |
| 40–45 | 205 |

As can be seen in Table 3, the oven cycle ranges from about 20 minutes to about 45 minutes at a temperature of about 205° C. (400° F.) or less. It is noted that the ranges disclosed in Table 3 include every number and/or fractional value within the disclosed ranges. It is further noted that the time period of the curing process for the powder coating primer may be up to 1.0 hour, so long as the temperature and time of the curing process does not decrease the wheel's mechanical properties. Additionally, one skilled in the art would recognize that the precise length of time used to cure the powder coating primer depends upon the size of the part and the amount of powder primer applied to the wheel. Additionally, the step of curing the powder coating primer onto the vehicle wheel may be conducted at a time and temperature that increases the strength of the wheel, substantially through precipitate hardening mechanisms.

As depicted in FIG. 2, after curing the powder coating primer onto the vehicle wheel, an image is transferred onto the cured primer by using a technique that is known in the art as dye sublimation. In one embodiment, an object, in this case a vehicle wheel, is draped in fabric, film, or paper (ink support material) carrying the image that is to be transferred onto the object. The draped object is then placed in a bag which is later placed in a vacuum machine. Finally, the air in the bag is evacuated under a vacuum created by the vacuum machine and the whole assembly (object, ink support material, and bag) is heated to transfer the image onto the object.

TABLE 4

Oven Temperature and Oven Cycle Times for Dye Sublimation

| Oven Temperature (° C.) | Oven Cycle Time (minutes) |
|---|---|
| 150–160 | 20–40 |
| 160–170 | 20–40 |
| 170–180 | 20–40 |
| 180–190 | 20–40 |
| 190–200 | 20–40 |
| 200–205 | 20–40 |

Table 4 discloses the oven temperature and oven cycle time typically required for the transfer of the image from the ink support material onto the primer coating of the vehicle wheel. As can be seen in Table 4, the temperature of the oven can range from about 150° C. to about 205° C. (300° F. to 400° F.) with an oven cycle time ranging from about 20 minutes to about 40 minutes. It is noted that the ranges disclosed in Table 4 include every number and/or fractional value within the disclosed ranges. For example, the curing cycle time can range from about 20 minutes to about 30 minutes or from about 30 minutes to 40 minutes. The process of heating the assembly to transfer the image from the ink support material to the vehicle wheel may be conducted at a time and temperature that increases the strength of the wheel, substantially through precipitate hardening mechanisms.

Although dye sublimation is preferred to transfer the image to the wheel, one skilled in the art would recognize that other techniques other than dye sublimation could be used to decorate the vehicle wheel. Such techniques would include, but shall not be limited to, ink jet printing, screen printing, pad printing, or specialized liquid/powder spraying.

As can be understood from FIG. 2, the final heating step involves applying a clear coating to the surface of the decorated wheel after it has cooled to room temperature in order to protect the transferred image from abrasion and color fading that is typically caused by ultraviolet (UV) light degradation. In one embodiment, the clear coating composition includes polyester.

The clear coating, which may be cured either thermally or with radiation such as ultra-violet light, infra-red light, or electron beam energy, is applied over the transferred image using techniques that are known to those skilled in the art. These techniques would include include liquid or powder spraying processes. After the clear coating has been applied to the vehicle wheel, the wheel is cured in an oven at temperatures and cycle times disclosed in Table 5 below.

TABLE 5

Oven Temperature and Cycle Times for Curing the Clear Coat

| Oven Temperature (° C.) | Oven Cycle Time |
|---|---|
| 150–155 | 20–40 |
| 155–160 | 20–40 |
| 160–165 | 20–40 |
| 165–170 | 20–40 |
| 170–178 | 20–40 |

As can be seen in Table 5, the final heating step is to cure the clear coating applied to the vehicle wheel at a temperature ranging from about 150° C. to about 178° C. (300° F. to 350° F.) with an oven cycle time ranging from about 20 minutes to about 40 minutes. It is noted that the ranges disclosed in Table 5 include every number and/or fractional value within the disclosed ranges. By the end of this final heating step, the decorated vehicle wheel will be at peak strength. Although the clear coating is preferred, the clear coating may be omitted.

Regardless of the number of coating steps, the inventive method maybe be practiced using a wheel composition that can be precipitate hardened, wherein the temperature coating process is not increased to greater than 205° C. and a processing time is selected that provides peak strength. It is noted that precipitate hardening may include solution heat treatment (dissolution of soluble phases); quenching (development of supersaturation); and age hardening at elevated temperatures (precipitation of solute atoms (precipitates), wherein the age hardening is provided by the curing temperatures and time of the decorative curing steps. The strength of age hardening is governed by the interaction and obstruction of moving dislocations and precipitates of the second phase within the original phase matrix. If the curing temperature is increased to greater than 250° C. the kinetics will favor a precipitate growth and distribution that does not provide a tensile strength suitable for automotive application, being on the order of about 40 Ksi.

In a preferred embodiment, the vehicle wheel is subjected to four heating steps ranging in temperature from about 150° C. to about 205° C. (300° F. to 400° F.) for times ranging from about 20 minutes to about 75 minutes. By utilizing these in-line thermal steps, the total number of heating steps needed to manufacture a vehicle wheel having peak strength is reduced.

One advantage of this invention is to have the ability to begin the coating/decorating process with a vehicle wheel that is not at peak strength and increase the temper of the wheel as it proceeds through the coating/decorating process so that the final coated/decorated wheel has a T6 temper.

Another advantage of the invention, is to provide a method that reduces the total number of process steps to achieve a decorated wheel at it's peak strength, by combining the curing steps of the decorative process with the heat treatment of the artificial aging (precipitate aging) process.

The following example is given to illustrate the effect of the inventive heat treatment on the mechanical properties of coated aluminum wheels. Because these examples are given for illustrative purposes only, the present invention should not be interpreted as being limited thereto.

EXAMPLE

In this example, a cast aluminum alloy wheel of Aluminum Association 6061 was sectioned into test specimen and then coated in accordance with the present invention, wherein the mechanical properties of the test specimen where measured at each stage of the coating process. The wheel had been solution heat treated and quenched to ensure a homogenous solid solution casting. The cast wheel was then sectioned into test samples and then processed using the method of the present invention, wherein mechanical properties were measured and recorded after each step in the coating process.

Referring to FIG. 3, a table is provided of the yield strength, ultimate tensile strength, and elongation measured from test samples following application of the base coat, powder primer coat, image and clear coat.

An acrylic powder based base coat was applied and then cured at temperature of 181–185° C. for a time period of approximately 26 minutes. Following curing, the test specimen were measured to have an average yield strength of 23.3 Ksi, a tensile strength of 39.7 Ksi, and an Elongation of approximately 23.8%, as indicated in the table depicted in FIG. 3.

In a next step of the coating process, a polyester powder primer coat was applied and then cured at a temperature of 190.5 to 200° C. for a time period of 55 minutes. The total curing time at this point in the process was equal to 81 minutes. Following curing, the test specimen were measured to have an increased average yield strength of 33.2 Ksi, an tensile strength of 41.6 Ksi, and an Elongation of approximately 22.0%, as indicated in the table depicted in FIG. 3.

An image was then transferred from a ink support material to the surface of the wheels using dye sublimation. Specifically, the ink support material carrying the image was draped over the wheel, wherein the wheel and ink support material were subjected to a vacuum at a temperature to transfer the image from the support material to the wheel. The oven temperature ranged from about 190.5 to about 200° C., wherein the oven cycle time required to transfer the image was on the order of about 25 minutes. The total heat treatment time at this point in the process was equal to 106 minutes. Following image transfer the test specimen were measured to have an increased average yield strength of 37.2 Ksi, an increased tensile strength of 44.4 Ksi, and an Elongation of approximately 12.4%, as indicated in the table depicted in FIG. 3.

In a final coating step, a polyester powder clear coat was applied and then cured at a temperature of about 170.5° C. for time of approximately 25 minutes. The total heat treatment time at this point in the process was equal to 131 minutes. The total heat treatment time at this point in the process was equal to 106 minutes. Following clear coat application, the test specimen were measured to have an average yield strength of 35.2 Ksi, an tensile strength of 41.3 Ksi, and an Elongation of approximately 20.3%, as indicated in the table depicted in FIG. 3.

The above embodiments and examples are given above to illustrate the scope and spirit of the present invention. These embodiments and examples will make apparent, to those of ordinary skill in the art, other embodiments and examples. These other embodiments and examples are within the contemplation of the present invention. Therefore, the present invention should be limited only by the appended claims.

What is claimed is:

1. A method of increasing the temper of an object to peak strength comprising:

providing an object comprising a substantially homogeneous solution of a precipitate hardening composition; and applying an image atop at least a portion of said object, wherein temperature and time of at least said applying of said image provide peak strength in said object.

2. The method of claim 1 wherein said applying said image comprises:

applying a primer coating to said object; and applying said image over said primer coating.

3. The method of claim 1 wherein said precipitate hardening composition comprises aluminum.

4. The method of claim 3 wherein said precipitate hardening composition comprises Aluminum Association's A356, 6061 or 5454 aluminum alloy.

5. The method of claim 2 wherein said primer coating is cured at about 205° C. for a time interval ranging from about 20 minutes to about 45 minutes.

6. The method of claim 5 wherein said primer coating is a liquid or a powder comprising polyester.

7. The method of claim 2 wherein said object is decorated using dye sublimation, ink jet printing, screen printing, pad printing, or liquid/powder spraying.

8. The method of claim 2 wherein said applying said image over said primer coating comprises transferring said image from an ink support material onto said primer coating, wherein said transferring of said image comprises positioning said ink support material atop said primer coating and applying a vacuum at a temperature of less than 205° C.

9. The method of claim 2 further comprising applying a basecoat to said object prior to applying said primer coating.

10. The method of claim 9 wherein said base coat is an acrylic based liquid or a powder coating.

11. The method of claim 10 wherein said base coat is cured at a temperature ranging from about 150° C. to about 205° C. (300° F. to 400° F.) for a time interval ranging from about 20 minutes to about 75 minutes.

12. The method of claim 9 wherein said primer coating is applied over said base coat at a thickness ranging from about 50 microns to about 100 microns.

13. The method of claim 2 further comprising applying a clear coating over said image.

14. The method of claim 13 wherein said clear coating is cured at a temperature ranging from about 150° C. to about 205° C. for a time interval ranging from about 20 minutes to about 40 minutes.

15. The method of claim 13 wherein said clear coating is cured thermally or with radiation.

16. A method of increasing the temper of a vehicle wheel to peak strength comprising:

providing a wheel comprising a substantially homogeneous solution of a precipitate hardening composition;

applying an adhesion layer to said wheel;

contacting said adhesion layer with an ink support material having an image disposed thereon; and applying a vacuum to said wheel and said ink support material at a temperature to transfer said image from said ink support material onto said adhesion layer, wherein temperature and time for applying one of at least said adhesion layer and said image provides peak strength in said vehicle wheel.

17. The method of claim 16 wherein said precipitate hardening composition comprises Aluminum Association's A356, 6061 or 5454 and said temperature is no greater than 205° C.

18. The method of Claim 16 wherein said adhesive layer comprises an acrylic base coat formed on said wheel and a polyester primer coat formed on said acrylic base coat.

19. The method of claim 16 further comprising a clear coat applied on said image, wherein said clear coat comprises polyester.

20. The method of claim 16 wherein said peak strength comprises a yield strength of approximately 40 Ksi.

* * * * *

UNITED STATES PATENT AND TRADEMARK OFFICE

CERTIFICATE OF CORRECTION

PATENT NO. : 7,226,641 B2
APPLICATION NO. : 11/343089
DATED : June 5, 2007
INVENTOR(S) : Vega et al.

It is certified that error appears in the above-identified patent and that said Letters Patent is hereby corrected as shown below:

In column 1, line 9, following “as”, delete “is” and insert --if--.

In column 4, line 8, before “to”, delete “time”.

In column 6, line 64, following “would”, delete the first occurrence of “include”.

In column 7, line 23, following “method”, delete “maybe” and insert --may--.

In column 8, line 3, before “measured”, delete “where” and insert --were--.

In column 8, line 48, following “minutes.”, delete “The total heat treatment time at this point in the process was equal to 106 minutes.”

Signed and Sealed this

Thirteenth Day of November, 2007

JON W. DUDAS
*Director of the United States Patent and Trademark Office*